United States Patent [19]

Warren

[11] 4,016,693

[45] Apr. 12, 1977

[54] INSULATED MASONRY BLOCK

[75] Inventor: Millard R. Warren, Knoxville, Tenn.

[73] Assignee: Warren Insulated Bloc, Inc., Knoxville, Tenn.

[22] Filed: Aug. 22, 1975

[21] Appl. No.: 606,934

[52] U.S. Cl. ..... 52/405; 52/404; 52/605

[51] Int. Cl.[2] ..... E04B 2/00; E04B 5/04

[58] Field of Search ..... 52/405, 404, 407, 309, 52/606, 607, 604, 406, 396, 605, 220

[56] References Cited

UNITED STATES PATENTS

| | | | |
|---|---|---|---|
| 1,415,222 | 5/1922 | Cramer | 52/604 |
| 2,172,051 | 9/1939 | Robbins | 52/606 |
| 2,199,112 | 4/1940 | O'Leary | 52/405 |
| 2,199,946 | 5/1940 | Barnhart | 52/310 |
| 2,737,801 | 3/1956 | Barnhart | 52/606 |
| 2,852,934 | 9/1958 | Amundson | 52/405 |
| 3,546,833 | 12/1970 | Perreton | 52/405 |
| 3,885,363 | 5/1975 | Whittey | 52/405 |

FOREIGN PATENTS OR APPLICATIONS

| | | | |
|---|---|---|---|
| 697,378 | 11/1964 | Canada | 52/405 |
| 454,944 | 2/1950 | Italy | 52/606 |

*Primary Examiner*—Price C. Faw, Jr.
*Assistant Examiner*—Robert C. Farber
*Attorney, Agent, or Firm*—Burns, Doane, Swecker & Mathis

[57] ABSTRACT

A masonry block is disclosed having a pair of spaced opposed side walls forming only a single cavity therebetween. The side walls define the outer side periphery portions of the block and include mutually facing inner surfaces. At least two opposed web walls extend between the side walls. The web walls have inner surfaces extending between the inner surfaces of the side walls. The web walls include channels situated intermediate the ends of the inner web surfaces. The channels extend in a top-to-bottom direction and converge toward the bottom of the block. An insulative plate of thermally insulative material is disposed in the cavity with the ends thereof being mounted in the channels. The insulative plate is situated intermediate the side walls to divide the cavity into a pair of air cells separating the insulative plate from the side walls. The single cavity formed between the side walls may be partitioned into a plurality of cavity portions by one or more intermediate web walls.

5 Claims, 7 Drawing Figures

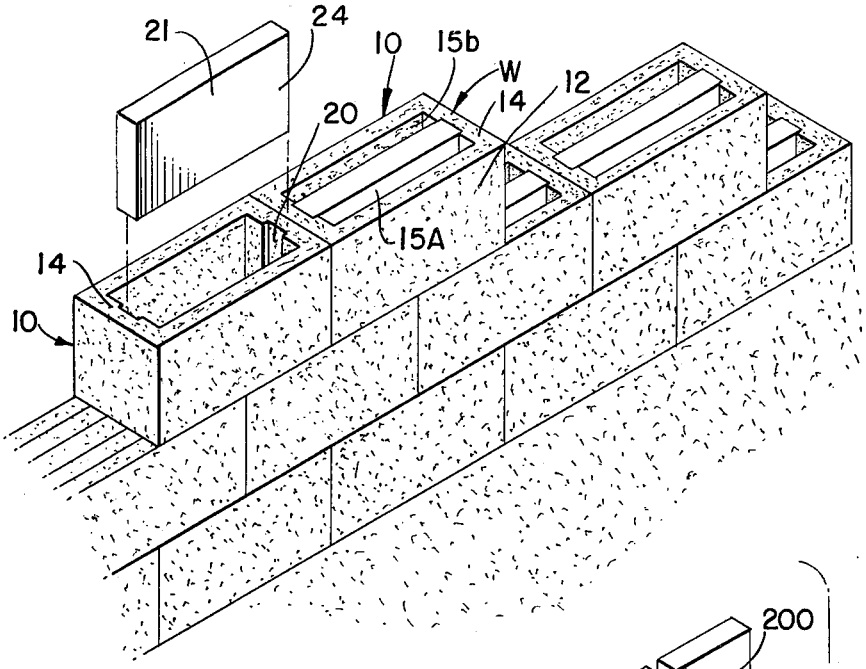
FIG. 1.
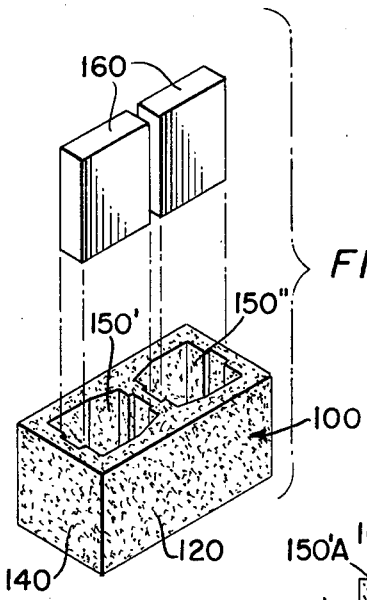
FIG. 3A.
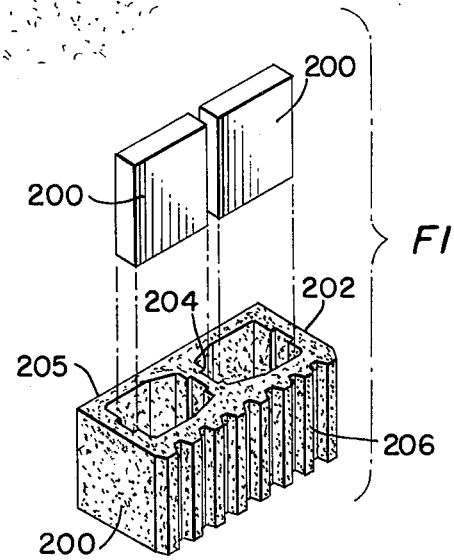
FIG. 4.
FIG. 3B.
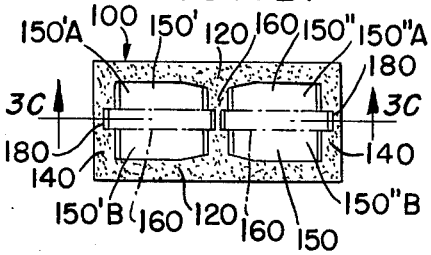
FIG. 2A.
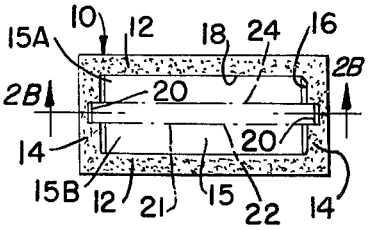
FIG. 3C.
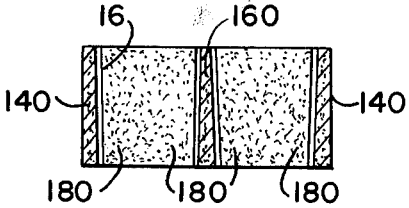
FIG. 2B.
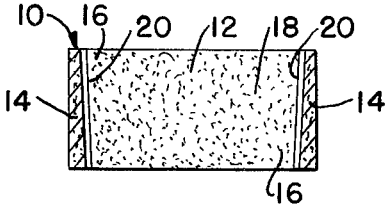

INSULATED MASONRY BLOCK

BACKGROUND AND OBJECTS OF THE INVENTION

The present invention relates to masonry blocks used in construction and more particularly to the thermal insulation of such a block.

The current world-wide emphasis on energy conservation has prompted the proposal of numerous techniques for thermal insulation of buildings and other structures. Heretofore, buildings have been insulated in many different ways, presenting problems of varying sorts. One common method of building construction involves the use of masonry blocks which are of concrete casting. The blocks are bonded together to form the shell of the building. Insulation of such walls by applying layers of thermally insulative material to the surface of these walls to meet the required thermal insulation standards involves considerable expense and loss of interior building space. These problems have promoted numerous proposals which involve the placement of a thermal insulation medium within a concrete block. In this connection, attention is directed to U.S. Pats. Nos. 1,884,319; 2,199,112; 2,852,934; 2,933,146; 3,204,381; 3,546,833; and 3,704,562 for examples of such structure.

Another proposal involves the placement of U-shaped styrofoam inserts within the recesses of concrete blocks. Each insert is installed such that the legs of the insert lie parallel to one another flush against the inside and outside walls of the block and with the bight portion of the insert lying flush against a web of the block so as to extend transverse to the inside and outside surfaces of the block.

Among the disadvantages that can arise from the previous proposals are undue cost and less than optimum thermal insulation. For instance those blocks which must be of special design to adapt to the insulation add significantly to cost. In some instances significant portions of the block must be removed, thereby presenting problems regarding structural strength of the blocks. Those blocks which eliminate the advantage of thermally insulative air cells, or which unduly limit the ratio between air volume and concrete volume within the block, are incapable of achieving optimum insulative results. Blocks in which an extent of the insulation extends from the outer to the inner block wall increase the thermal travel path to an undesirable degree, thereby limiting the thermal insulative effects that can be achieved.

It is, therefore, an object of the present invention to provide a novel insulated masonry block of low cost, high thermally insulative construction.

It is an additional object of the invention to provide an insulated masonry block which is applicable to conventional block designs and which requires only minimal amounts of insulative material.

It is yet another object of the invention to provide an insulated masonry block which incorporates a high/air concrete ratio and minimizes the size of non-insulated heat transfer paths.

It is yet another object of the invention to provide an insulative block structure which requires no significant reduction in size of structural support portions of the block and which can be pre-assembled prior to erecting a wall.

It is a further object of the invention to provide a novel method for assembling a wall of insulative concrete blocks.

BRIEF DESCRIPTION OF THE INVENTION

These objects are achieved by the present invention which involves a masonry block comprising a pair of spaced opposed side walls forming only a single cavity therebetween. The side walls define the outer side peripheral portions of the block and have mutually facing inner surfaces. At least two opposed web walls extend between the side walls. The web walls have inner surfaces extending between the inner surfaces of the side walls. The web walls include channel-forming structure situated intermediate the ends of the inner web surfaces for forming channels that extend in a top-to-bottom direction. Insulative plate structure of thermally insulative material is disposed in the cavity with the ends thereof being mounted in the channels. The insulative plate structure is situated intermediate the side walls to divide the cavity into a pair of air cells separating the insulative plate structure from side walls. The block is assembled by inserting the insulative plate structure into the cavity by forcing opposite ends of the plate structure into the channels. The blocks can be laid-up to form a wall and then bonded together, exclusive of mortar joints by applying a one-eighth inch thick layer of reinforced bonding resin to two sides of the wall.

THE DRAWINGS

The invention is disclosed by way of preferred embodiments thereof depicted in the accompanying drawings wherein:

FIG. 1 depicts a plurality of insulated masonry blocks according to one embodiment of the invention in a stacked condition forming a wall;

FIG. 2A is a top plan view of the block depicted in FIG. 1;

FIG. 2B is a longitudinal sectional view taken along line 2B—2B of FIG. 2A;

FIG. 3A is an exploded isometric view of another preferred form of insulated masonry block according to the present invention;

FIG. 3B is a top plan view of the block depicted in FIG. 3A;

FIG. 3C is a longitudinal sectional view taken along line 3C—3C of FIG. 3B; and

FIG. 4 is an exploded isometric view of another preferred form of insulated block according to the present invention.

DETAILED DESCRIPTION OF THE PREFERRED EMBODIMENTS

Building blocks 10 according to the present invention are depicted in FIGS. 2A, 2B and in FIG. 1 forming a wall W. The block 10 includes a pair of opposed side walls 12 forming inner and outer portions of the wall W, and a pair of opposed web walls 14. Each block 10 is molded of masonry material, such as concrete, to form a hollow rectangular structure having a pair of opposed side walls 12 and a pair of opposed web or tie walls 14 extending between the ends of the side walls 12. The side and web walls define a cavity 15. The side walls 12 and the web walls 14 are of substantially the same thickness and define the outermost periphery of the block. The web walls 14 have mutually facing inner surfaces 16 which extend between mutually facing inner surfaces 18 of the walls 12.

The cavity 15 is defined by both of the side walls 12. That is, there is only one cavity disposed between and defined by both side walls 12. As will be discussed subsequently in connection with other preferred forms of the invention, some of which are depicted in FIGS. 3 and 4, one or more additional web walls can be provided internally of the outermost web walls to partition the sole cavity 15 into cavity portions.

Each web wall 14 includes an internal channel 20 formed approximately midway between the ends of the web wall surfaces 16. As depicted in FIG. 2B, the channels 20 are in mutually facing relation, each extending in a top-to-bottom direction of the block 10. These channels may be formed during the molding process, or may be subsequently machined into the block. The channels 20 are preferably fashioned so as to converge inwardly from top to bottom, as depicted in FIG. 2B.

Mounted within the block 10 is a plate or panel 21 formed of thermally insulative material. The insulative plate 21 is positioned such that outer faces 22, 24 thereof extend between the web wall surfaces 16 in directions parallel to the side wall surfaces 18. In this fashion the plate 21 divides the cavity 15 into a pair of air cells 15A, B with each air cell 15A, B being bordered by: a portion of each web wall inner surface 16, one of the insulative plate faces 22, 24, and the side wall inner surface 18 which is in mutually facing relation to that inner plate face.

Thus, the arrangement is such that a masonry block 10 of substantially standard design is provided with a pair of air cells 15A, B separated by a layer of thermally insulative material for retarding heat and vapor transfer.

The type of insulative plate material to be employed, as well as its thickness, depends upon the degree of resistance to thermal conductivity that is desired. Possible types of insulative material include polystyrene, urethane, styrofoam, and fiberglass.

In use, the concrete block 10 is precast in a conventional manner. Suitable channels 20 can be formed during molding or machined into the web walls 14 subsequent to the molding operation. The insulative plate 21 is manually press-fitted into the channels 20. The convergent nature of the channels 20 causes the plate to be slightly compressed into a snug fit within the block. Insertion of the insulation plates can be accomplished at the block fabrication facility, or can be performed later at a building site.

The blocks 10 are used in a conventional manner in the erection of a structure as shown in FIG. 1. That is, the blocks 10 are laid-up in staggered or non-staggered relation, with the side walls 12 forming the interior and exterior wall surfaces of the structure. The insulative plates can be inserted before or after a row of blocks are laid-up merely pressing the plate into the channels 20. The convergent nature of the channels serves to firmly hold the plate in place. Bonding of the blocks together can be performed by conventional mortar application between blocks or by the application of a bonding resin to the exterior of the structure. One conventional type of such resin is sold by Owens-Corning Fiberglass Company under the trade name Bloc-Bond. This resin has a portland cement base and is reinforced with fiberglass. Application of the resin is made in a ⅛ inch layer onto the exterior and interior surface of a wall of freestanding blocks. By thus eliminating the use of mortar the amount of non-insulated wall area is significantly reduced.

The present inventive concepts is highly advantageous in that it can be utilized in conjunction with blocks of standard design. Thus, the insulation is adapted to the block, rather than the block being adapted to the insulation. No significant reduction in size of the block is required to accommodate the insulative plates. Also, the plates can be inserted into the blocks before a wall is laid-up, if desired.

Moreover, since the block of the present invention involves only a pair of side walls with only one cavity disposed therebetween, the ratio of air volume to concrete volume is maximized to retain a high insulative factor. In certain prior art proposals there are employed a plurality of staggered cavities between the side walls, the added presence of masonry between the staggered cavities serving to reduce the air/concrete ratio.

Furthermore, the block of the present invention provides plural air gaps or cells 15A, B to retard thermal conductivity. It is expected that a significantly higher insulative factor is achieved when the insulative plate is disposed in spaced relation from both of the side walls 12, as opposed to being situated flush against one or both of the side walls.

Importantly, no portion of the insulative plate of the present block extends from one side wall to the other in flush engagement with a web wall, thus avoiding an enlargement of the effective heat transfer path.

Since the insulative plate 21 of the present invention extends across only one major dimension of the cavity 15 (i.e., parallel to the side walls) and since only one cavity is disposed between the side walls, only a minimal amount of insulative material is required per block.

Insulative materials of a waterproof nature, such as those previously listed, can be routinely employed to prevent the occurrence of water damage to the plates, especially during inclement conditions at the construction site.

The previously discussed principles and advantages can be incorporated with conventional masonry blocks of various design. FIGS. 3A–C depict a standard block 100 in which a pair of side walls 120 and web walls 140 define the outer periphery of the block and an inner cavity 150. The inner cavity 150 is partitioned into cavity portions 150′, 150″ by an intermediate web wall 160. Thus, the block 100 is characterized by a single cavity 150 disposed between and defined by the side walls 120, with the cavity 150 being divided into a plurality of cavity portions 150′, 150″ between the outer web walls 140.

Within each of the cavity portions 150′, 150″ an insulative plate portion 160 of the type previously discussed can be manually inserted. The insulative plate portion 160 is inserted into downwardly convergent channels 180 formed in the outer web walls 140 and intermediate web wall 160. As a result, each insulative plate partitions its respective cavity portion into a pair of air cells 150′A, B and 150″A, B.

In FIG. 4 the use of insulative plates 200 is depicted in conjunction with a conventional block 202 having an intermediate web wall 204, a planar side wall 205 and a corrugated side wall 206.

It will thus be realized that the embodiments disclosed in conjunction with FIGS. 3 and 4 are characterized by the provision of a masonry block having only a single cavity interposed between and defined by the side walls, and plural air cells separated by a layer of insulation, as in the manner of the embodiment disclosed in conjunction with FIGS. 2A, 2B.

Blocks of a design other than that depicted in FIGS. 2, 3, and 4 and other than a standard design can, if desired, be utilized in accordance with the aforestated principles of the invention.

In order to demonstrate the insulative effectiveness of the present invention, thermal conductivity factors have been calculated for an eight inch masonry block of the type disclosed in conjunction with FIGS. 3A–C having web length and depth dimensions of 7⅝ inches and a side length of 15⅝ inches. The thickness of each side wall is approximately 1¼ inches. An insulation plate thickness of 1½ inches provides air cells of about 1 8/10 inches on each side of each insulation plate portion. Total insulation area is about 92.45 square inches. The table below indicates the conductivity rates, i.e., U factors calculated for such a block design formed of concrete having various weight values with different types of insulative material:

| Concrete Weight | Insulation Thickness | Inside Density Designation | Insulation Material | U Factor |
|---|---|---|---|---|
| No. 60 | 1" | 1lb. | Polystyrene | .128 |
| No. 80 | 1" | 1½lbs. | Polystyrene | .144 |
| No. 100 | 1½" | 1½lbs. | Polystyrene | .122 |
| No. 100 | 2" | 2lbs. | Polystyrene | .095 |
| No. 100 | 3" | 2lbs. | Urethane | .059 |
| No. 100 | 4" | 2lbs. | Urethane | .044 |
| No. 120 | 1½" | 2lbs. | Polystyrene | .089 |
| No. 120 | 2" | 2lbs. | Urethane | .088 |
| No. 140 | 2" | 2lbs. | Polystyrene | .099 |
| No. 140 | 2" | 2lbs. | Urethane | .085 |
| No. 140 | 4" | 2lbs. | Urethane | .048 |

It will be appreciated from a review of the foregoing chart that extremely low U factors are available in accordance with the present invention.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A masonry block comprising:

a pair of spaced opposed side walls forming only a single cavity therebetween, said cavity being open at its top and bottom ends;

said side walls defining the outer side periphery portions of said block, and having mutually facing inner surfaces;

at least two opposed web walls extending between said side walls;

said web walls being integral with said side walls and having inner surfaces extending between the inner surfaces of said side walls;

said web walls including channel-forming means situated intermediate the ends of said inner web surfaces for forming channels extending in a top-to-bottom, said channels being mutually convergent in a downward direction;

insulative plate means of thermally insulative, compressible material disposed in said cavity with the ends thereof being mounted in said channels;

said plate means having an uncompressed, end-to-end dimension which is longer than the distance between the lower ends of said convergent channels, so that with said plate means being disposed in said channels the ends of said plate means are compressed to snugly frictionally engage said channels;

said insulative plate means being situated intermediate said side walls to divide said cavity into a pair of air cells separating said insulative plate means from said side walls, said air cells each being open at their open at their top and bottom ends.

2. A block according to claim 1 wherein said block includes only two web walls extending between the ends of said side walls.

3. A block according to claim 1 wherein said block includes a pair of outer web walls secured to outer ends of a pair of said side walls, and an intermediate web wall partitioning said cavity into first and second cavity portions, said outer web walls having inner surfaces facing opposite surfaces of said intermediate web wall; said inner surfaces of said outer web walls and said opposite surfaces of said intermediate web wall each having one of said channels; said insulative plate means comprising first and second plate portions disposed in said first and second cavity portions.

4. A block according to claim 1 wherein said insulative plate means being spaced substantially equidistantly from each of said side wall inner surfaces.

5. A masonry building block comprising:

a pair of side walls forming only a single cavity therebetween, said cavity being open at its top and bottom ends;

said side walls having mutually facing inner surfaces;

a pair of outer web walls extending between the ends of said side walls;

said outer web walls having inner surfaces;

at least one intermediate web wall situated intermediate said outer web walls, said intermediate web wall extending between said side wall inner surfaces in a direction parallel to said outer web walls and dividing said cavity into a plurality of cavity portions;

said outer web walls and said intermediate web walls being integral with said side walls and extending substantially the full height of said side walls;

said intermediate web wall having opposed surfaces;

each of said outer web wall surfaces and said intermediate web wall surfaces having a channel oriented in a top-to-bottom direction, with mutually facing ones of said channels converging in a downward direction; and insulative plate means comprising a plurality of plate portions of thermally insulative, compressive material disposed in each cavity portion, with the ends of each plate portion being mounted in mutually facing pairs of said channels;

said plate portions each having an uncompressed, end-to-end dimension which is longer than the distance between the lower ends of said convergent channels in each cavity portion, so that with said plate portions being disposed in said channels the ends of said plate portions are compressed to snugly frictionally engage said channels;

said insulative plate portions extending parallel to said side walls intermediate said side walls to form a pair of air cells in each cavity portion;

each air cell being defined by a portion of the inner surface of one of said side walls, portions of the inner surfaces of a pair of said web walls, and one side of one of said insulative plate portions, with each air cell being opened at its top and bottom ends.

* * * * *